United States Patent [19]

Gagnet

[11] Patent Number: 4,462,570

[45] Date of Patent: Jul. 31, 1984

[54] HOIST OVERLOAD LIMITER

[75] Inventor: Thomas R. Gagnet, Moneta, Va.

[73] Assignee: Ingersoll-Rand Company, Woodcliff Lake, N.J.

[21] Appl. No.: 411,501

[22] Filed: Aug. 25, 1982

[51] Int. Cl.[3] ..... B66D 1/48; B66D 5/26

[52] U.S. Cl. ..... 254/268; 254/379

[58] Field of Search ..... 254/360, 268, 270, 272, 254/273, 378, 379, 332, 356; 73/862.56, 862.58

[56] References Cited

U.S. PATENT DOCUMENTS 3,780,990 12/1973 Edlund et al. ..... 254/379 X 3,957,248 5/1976 Hannson ..... 254/356

4,226,403 10/1980 Schörling ..... 254/273

*Primary Examiner*—Stuart S. Levy

*Assistant Examiner*—Joseph J. Hail, III

*Attorney, Agent, or Firm*—Walter C. Vliet

[57] ABSTRACT

Limiting of hoist overload is accomplished by applying the brake of a pneumatically powered hoist. The brake release signal is interrupted by means of directly sensing the load being lifted by means of this invention, causing the brake to be applied and thus halting the drive mechanism. This device can be applied to any load bearing member such as chain or cable anchors, hooks, connections to trolleys, or other suspension.

5 Claims, 3 Drawing Figures

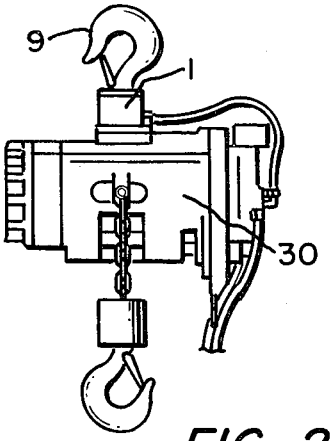
FIG. 2
FIG. 1
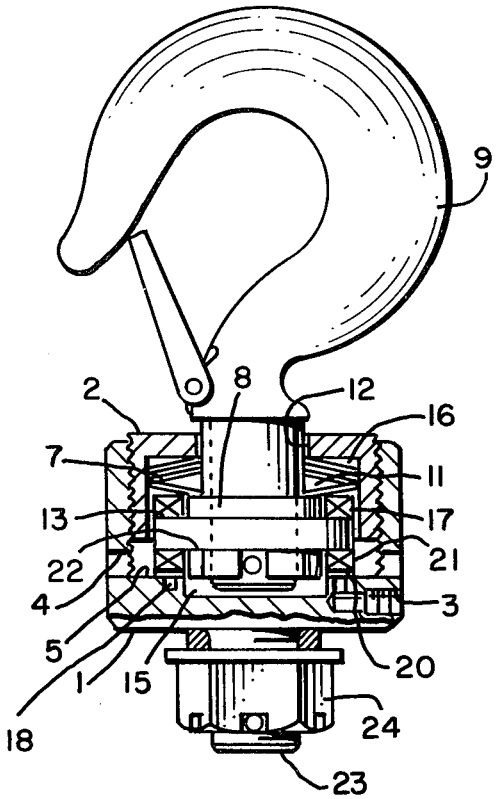
FIG. 3
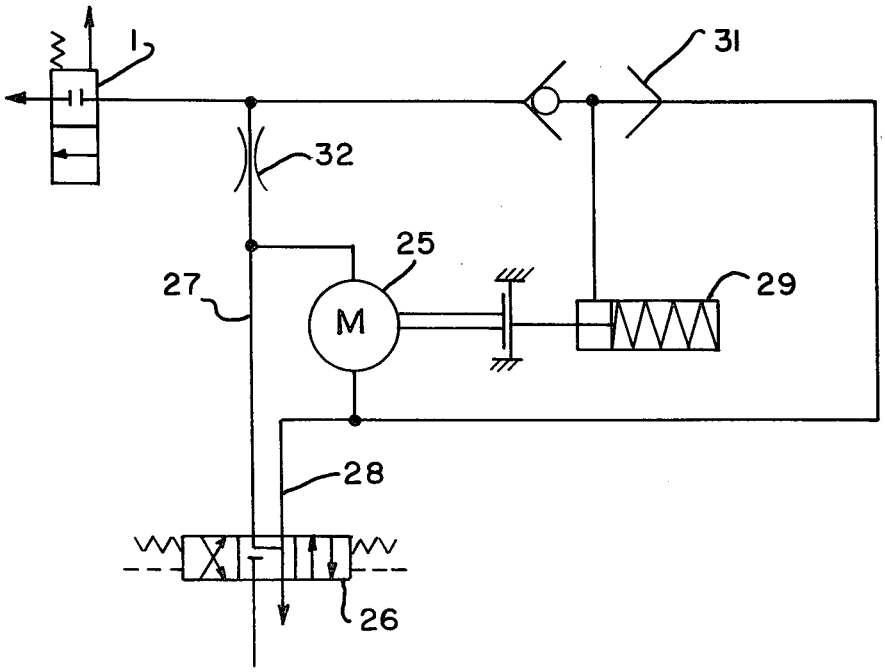

HOIST OVERLOAD LIMITER

BACKGROUND OF THE INVENTION

Hoists without an overload device can pick up loads in excess of their rated capacity. This results in overloading not only the load bearing parts of the hoist but also the structure from which the hoist is suspended. Although it is desirable to prevent lifting of such overload, on occasion, hoists are confronted with overload conditions and it is desirable to have them function in their lowering mode regardless of the load. Prior art devices have accomplished load limiting by venting the pneumatic fluid supplied to the motor. This requires the venting of a relatively large volume of air to accomplish the purpose of the safety device.

SUMMARY OF THE INVENTION

The present invention limits the overload of the hoist by applying the pneumatic brake commonly associated with the hoisting device. The brake signal, which is utilized to release the brake during raising of the load, is interrupted by venting of the brake release signal through a device which directly senses the overload. This causes the brake to remain applied thus halting the drive of the lifting mechanism. By means of a suitable shuttle valve, the venting device is disabled in the lowering of the load regardless of overload. The object of the invention is to provide a safe, simple and reliable means to prevent the hoist from lifting an overload by having its brake set on overload while enabling the hoist to lower the load under the overload conditions. These and other objects are accomplished in a load limiting device for pneumatically driven hoist devices having a brake which is normally set and which is released by a pneumatic signal only on activation of the hoist in its raising and lowering mode comprising a load sensing means communicating with the pneumatic brake signal to disable the signal on a selected condition and thereby prevent release of the brake and operation of the hoist.

BRIEF DESCRIPTION OF THE DRAWINGS

FIG. 1 shows a partial cross-section elevation of the load sensing means according to the present invention.

FIG. 2 shows the load sensing means as applied in a typical hook mounted hoist.

FIG. 3 shows the pneumatic schematic for operation of the hoist embodying the present invention.

DESCRIPTION OF THE PREFERRED EMBODIMENT

As shown in FIG. 1, the load sensing means 1 according to the present invention is composed of a hollow cylindrical body, indicated by reference numeral 5, which is closed at one end. A cylindrical top cap 2, having exterior threads thereon, is threadingly engaged with internal threads of the cylindrical body 1 at its other end. The engagement of the top cap 2 with the cylindrical body 1 forms a variable length chamber 11 therebetween. A specially formed hook nut 8 is disposed in the chamber 11 and extends outward of the chamber 11 through a bore 12 in the top cap 2. The hook nut 8 is provided with a piston like land 13 which effectively separates the chamber 11. The portion of the chamber 11 towards one end may be considered to be the vent chamber 15, and the portion of the chamber towards the other end may be considered to be the spring chamber 16. Belville spring washers 7 provide preload force to the land 13 of the hook nut 8 through a set of needle bearings 17 and hardened races. Pneumatic pressure fluid which is to be vented according to the present invention is introduced into the vent chamber 15 through threaded port 3 and circular groove port 18. A face seal 20 is disposed over the circular groove port and is retained there by the hook nut land 13 through contact with needle bearing 21 with hardened races. The chamber 11 is vented to atmosphere through vent hole 4.

As can be appreciated by one skilled in the art, the pressure at which the face seal 20 is lifted to allow venting is dependent on the amount of preload which is in turn dependent on the amount the top cap 2 is screwed into the cylindrical body 1. A load hook 9 is shown attached to the hook nut 8 by threading engagement and a suitable pinned lock nut 22. A mounting stud 23 and mounting nut 24 are shown attached to the closed end of the cylindrical body 1.

As can be appreciated by one skilled in the art, a load force axially applied to the hook 9 will cause the hook nut 8 to be displaced towards the top cap 2 once the preload force exerted by the spring washers 7 is overcome. This, in turn, will allow face seal 20 to be displaced and allow pressure fluid to be vented from threaded port 3 and circular groove port 18 through vent chamber 15 and to atmosphere through vent hole 4. The bearings 17 and 21 allow the hook nut 8 and hence the hook 9 to freely rotate within the chamber 11 without effecting the venting operation.

It should be further appreciated by one skilled in the art that the hook may be replaced by a stud mount similar to mounting stud 23 and mounting nut 24 for use in other types of mounting such as a trolley mount or in the cable lines of a reeved hoist. The form of mounting does not effect the operation of the device.

FIG. 2 shows the load sensing means 1 of this invention installed in a typical hook mounted hoist 30.

FIG. 3 shows the pneumatic schematic for operation of the hoist embodying the present invention. Pneumatic pressure fluid is supplied to the hoist motor 25 through a typical directional control valve 26. When the raise mode is selected on the directional control valve, line 27 is pressurized and line 28 is exhausted to atmosphere. When the lowering mode is selected, line 28 is pressurized and line 27 is exhausted to atmosphere.

A spring applied pneumatically released brake 29 is shown which engages the drive mechanism of the motor 25. When the brake is applied, the motor 25 cannot rotate and therefore cannot lift the load. Pneumatic pressure to release the brake 29 may be supplied from line 27 or line 28 depending on the mode selected. A shuttle valve 31 is utilized to separate the supply and exhaust side of the circuit depending on the mode selected.

On the lift side, that is, when line 27 is pressurized, a restriction 32 is placed in the line to the shuttle valve 31. The load sensing means of the present invention 1, which is shown in schematic as a spring biased control valve, is connected to the pressure line between the restriction 32 and the shuttle valve 31. As can be appreciated by one skilled in the art, when the raise mode is selected and line 27 is pressurized, pneumatic fluid will be fed to one side of the motor 25. Simultaneously, it will also be fed through restriction 32 and shuttle valve 31 (with its sealing element shifted to the right), to the piston chamber of the spring applied brake 29 to thereby release it, allowing the motor 25 to operate to raise the load. If, however, the load represents a overload, the load sensing means 1 will shift to vent the brake signal thereby causing the brake to be applied thereby stopping the motor 25 and preventing the hoist from lifting the overload. However, if the directional control valve is shifted to the lowering mode, it can be appreciated that pressure fluid will be applied to the reverse port of the motor 25 through line 28 and through shuttle valve 31 (with its sealing element as shown) to release the brake 29 thereby allowing the hoist motor to lower the load without interference of the load sensing means.

Having described my invention in terms of a preferred embodiment, it should be understood that numerous modifications and variations are possible without effecting the spirit of the invention, and I do not wish to be limited in the scope of my invention except as claimed.

I claim:

1. A load limiting device for suspending a pneumatically driven hoist having a brake which is normally set and is released by a pneumatic brake signal only on activation of the hoist in its raising or lowering mode comprising: a hoist suspending hook a load sensing means suspending said hoist and communicating with the pneumatic brake signal to disable said signal on an overload condition and thereby prevent release of the brake and operation of the hoist, said load sensing means including a venting means a chamber containing a spring means and a sealing means, said spring means biasing said sealing means whereby said sealing means prevents venting of said pneumatic brake signal during operation with normal loads and permits venting of said pneumatic brake signal on overload, said sealing means is connected to the hoist suspending hook through a bearing means mounting said load sensing means to function as a hook swivel having unlimited rotation; and said load sensing means including a spring means adjusting means to effect the desired release of the sealing means.

2. The load limiting device according to claim 1 wherein the load sensing means disables said signal only on the raising of an overated load.

3. The load limiting device according to claim 1 wherein said sealing means comprises a hook nut, a face seal means in operable contact with said hook nut said spring means comprises a plurality of spring washers for biasing said hook nut.

4. The load limiting device according to claim 3 wherein said hook nut is disposed between said spring washers and said face seal means, and said bearing means are disposed between said hook nut and said spring washers, and said hook nut and said face seal means to allow rotation of said hook nut independent of said spring washers and said face seal means.

5. The load limiting device according to claim 1 wherein said load sensing means is disposed between a restriction and said brake to minimize venting loss on overload.

* * * * *